US005117462A

United States Patent [19]

Bie

[11] Patent Number: 5,117,462

[45] Date of Patent: May 26, 1992

[54] PHASING PLUG FOR COMPRESSION DRIVER

[75] Inventor: David D. Bie, Sepulveda, Calif.

[73] Assignee: JBL Incorporated, Northridge, Calif.

[21] Appl. No.: 672,188

[22] Filed: Mar. 20, 1991

[51] Int. Cl.[5] ..... H04R 25/00

[52] U.S. Cl. ..... 381/156; 381/158; 381/202; 181/159; 181/185

[58] Field of Search ..... 381/156, 157, 158, 199, 381/202, 90; 181/152, 159, 185

[56] References Cited

U.S. PATENT DOCUMENTS

| | | | |
|---|---|---|---|
| 2,037,187 | 4/1936 | Wente | 381/156 |
| 4,050,541 | 9/1977 | Henricksen | 181/159 |
| 4,152,552 | 5/1979 | Meyer | 381/156 |
| 4,157,741 | 6/1979 | Goldwater | 181/156 |
| 4,164,631 | 8/1979 | Garner et al. | 381/156 |
| 4,325,456 | 4/1982 | Ureda | 181/159 |
| 4,975,965 | 12/1990 | Adamson | 381/156 |

FOREIGN PATENT DOCUMENTS

| | | | |
|---|---|---|---|
| 0012070 | 6/1980 | European Pat. Off. | 381/156 |
| 0048310 | 4/1977 | Japan | 381/156 |
| 0133123 | 10/1979 | Japan | 381/156 |

*Primary Examiner*—Jin F. Ng
*Assistant Examiner*—Huyen D. Le
*Attorney, Agent, or Firm*—Jones, Day, Reavis & Pogue

[57] ABSTRACT

An improved compression driver has a phasing plug with air passages coupling the compression region of the loudspeaker to the throat of the loudspeaker. An auxiliary air passage combines with a plurality of inner primary passages, which may be of the annular, radial or saltshaker form, to couple variations in pressure from the region around the voice coil to the throat of the speaker.

14 Claims, 3 Drawing Sheets

PHASING PLUG FOR COMPRESSION DRIVER

FIELD OF THE INVENTION

This invention relates to eleotrodynamic loudspeakers. In particular, it is an improved phasing plug for those types of loudspeakers known as compression drivers.

BACKGROUND OF THE INVENTION

A compression driver comprises a pole piece made of ferromagnetic material which has a bore therein, the front end or opening of which is adaptable for coupling to the throat of a horn. A diaphragm, usually circular with a central dome-shaped portion, is mounted adjacent the rear opening of the bore so as to be freely vibratable. Attached to the edge of the diaphragm's dome is a cylindrical coil of wire, the voice coil, oriented so that the cylindrical axis of the coil is perpendicular to the diaphragm and coincident with the axis of the pole piece bore. A static magnetic field, usually produced by a permanent magnet, is applied so that an alternating signal current flowing through the voice coil causes it to vibrate along its cylindrical axis. This in turn causes the diaphragm to vibrate along the axis of the bore and generate sound waves corresponding to the signal current. The sound waves are directed through the bore toward its front opening. The front opening of the bore is usually coupled to the throat of a horn which then radiates the sound waves into the air. In the description that follows, the term "throat" is used to mean either the front or downstream end of the pole piece bore or the actual throat of a horn. Interposed between the diaphragm and the pole piece bore is a perforated structure known as a phasing plug for impedance matching the output of the diaphragm to the horn. Within the phasing plug are one or more air passages or channels for transmission of the sound waves. The surface of the phasing plug opposite the diaphragm is of corresponding sphericity and positioned fairly close to the diaphragm while still leaving an air gap, or compression region, in which the diaphragm can vibrate freely.

The phasing plug effects two basic functions. First, because the cross-sectional area of the air channel inlets are smaller than the area of the diaphragm, the air between the diaphragm and the phasing plug (i.e., the compression region) can be compressed to relatively high pressures by motion of the diaphragm. This is what allows a compression driver to output sound at greater pressure levels than can conventional loudspeakers where the diaphragm radiates directly into the air. The efficiency of the loudspeaker is thus increased by virtue of the phasing plug being placed in close opposition to the diaphragm to minimize the volume of air between the diaphragm and the phasing plug Secondly, as the name "phasing plug" implies, the path lengths of the air channels within the phasing plug may be equalized so as to bring all portions of the transmitted sound wave into phase coherence when they reach the throat. Without such path length equalization, sound waves emanating from different air channels would constructively or destructively interfere with one another at certain frequencies so as to distort the overall frequency response.

Phasing plugs have been made with many designs. Perhaps the most frequently used type is one having annular cross-sections that usually increase in area as the principal radius of each annulus decreases in moving toward the throat of a speaker. This is shown, for example, in U.S. Pat. No. 2,037,187, entitled "Sound Translating Device," issued to Wente in 1936 and hereby incorporated by reference. Another type is the saltshaker design, so called because holes at the spherical outer surface of the plug that extend through to the throat of the speaker resemble the holes of a saltshaker. Another design that has been used, shown in U.S. Pat. No. 4,050,541, entitled "Acousticla Transformer for Horn-type Loudspeaker" and hereby incorporated by reference, couples the diaphragm region to the throat by radial slots extending from the axis of cylindrical symmetry of the speaker.

In order to provide a low reluctance magnetic pathway for the applied static magnetic field, the permanent magnet and the voice coil are disposed within a surrounding environment of ferromagnetic material. As both the magnet and voice coil are commonly located on the side of the diaphragm facing the pole piece, the magnetic pathway includes both the phasing plug and the surrounding pole piece. In order for the voice coil to be free to vibrate, however, it must be disposed within an annular air gap which will be referred to herein as the coil space. Ideally, the coil space should be made as small as possible since air in the magnetic pathway adds reluctance to the magnetic circuit which lessens the field strength at the voice coil. Nevertheless there is a considerable volume of air in the coil space surrounding the voice coil as well as in the spaces along the inner edge of the surround and outer edge of the diaphragm which are continuous with the coil space. This region, comprising the coil space and the space along the surround and outer edge of the diaphragm, is thus an uncoupled region since it is so far from the inlets of the phasing plug air passages that variations of air pressure in that region are coupled little or not at all to the phasing plug and thence to the throat. Such an unused volume is shown in the Wente patent referred to above. These pressure variations thus result in energy losses which lead to heating of the loudspeaker but do not result in the generation of useful sound output. The uncoupled region also causes cavity resonance effects which distort the overall sound output of the speaker due to anomalies in its frequency response. Such resonances, known as parasitic resonances, present a significant design problem for the speaker designer. (See, e.g., "The Influence of Parasitic Resonances on Compression Driver Loudspeaker Performance" by Kinoshita, et al. presented at the 61st Convention of the Audio Engineering Society in 1978 and available as preprint no. 1422 (M-2).)

It would be useful to couple the pressure variations in the uncoupled region around the voice coil to the throat of the horn, in addition to the pressure variations produced by the diaphragm, to improve the efficiency and sound quality of the loudspeaker. Use of the additional pressure variations could be expected to reduce heating in the region around the voice coil as a result of repeated compression and rarefaction of the same air in that region, to produce an increase in the efficiency of the loudspeaker, and to reduce parasitic resonances.

SUMMARY OF THE INVENTION

The present invention is a compression driver with an annular auxiliary air passage for providing an acoustic pathway between the uncoupled region outside of the voice coil and the throat. Sound waves generated by the vibration of the voice coil and surround are then output from the loudspeaker which thereby reduces heating, increases the efficiency of the loudspeaker, and reduces cavity resonance effects.

Further advantage may be obtained in accordance with the present invention if the auxiliary air passage is made thin so that the added magnetic reluctance is minimized. In order to achieve a compromise between minimizing added reluctance and providing an optimum air passage for soundwaves, part of the auxiliary air passage may be filled with ferromagnetic material.

It is an object of the present invention to provide a compression driver with increased efficiency, and which reduces cavity resonance effects. It is a further object of the present invention to provide a means for accomplishing the above objective in a manner that minimizes any added magnetic reluctance.

Other objects, features, and advantages of the invention will become evident in light of the following detailed description considered in conjunction with the referenced drawings of a preferred exemplary embodiment according to the present invention.

DETAILED DESCRIPTION OF THE INVENTION

Figure 1:
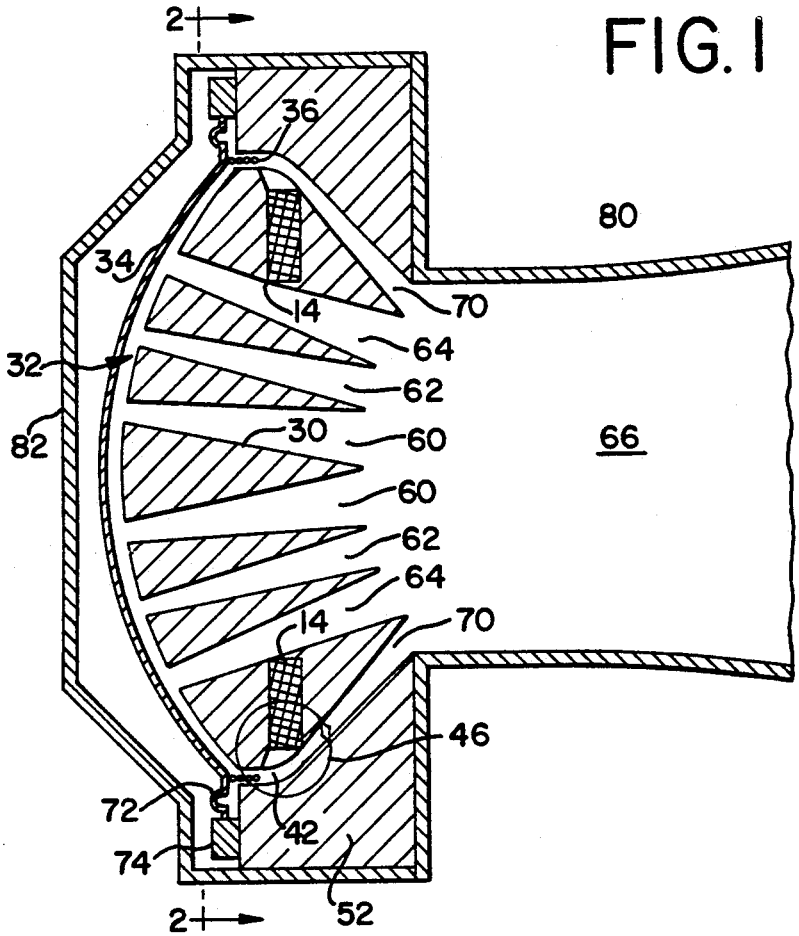
FIG. 1 is a sectional side view of a compression driver in accordance with the present invention, taken along an axis of cylindrical symmetry.
Figure 2:
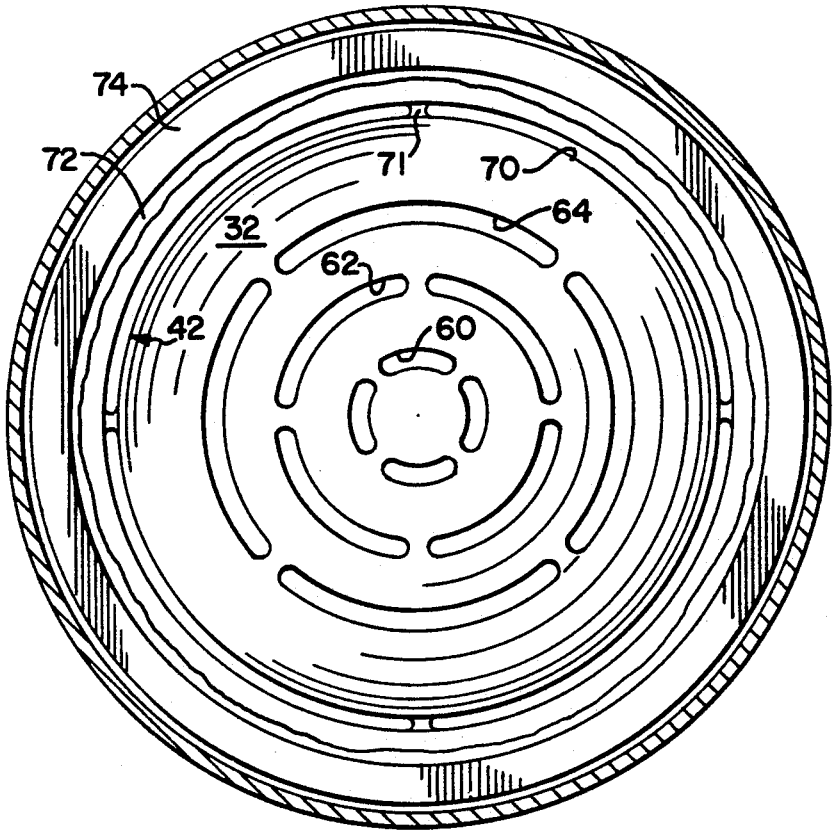
FIG. 2 is a cutaway rear view of the phasing plug of the compression driver of FIG. 1, taken along section lines 2—2 of FIG. 1.

Shown in FIG. 1 is an exemplary embodiment of a compression driver according to the present invention. All of the components in FIG. 1 which are to be described have cylindrical symmetry about a longitudinal axis. A diaphragm 34 is suspended from a mounting plate 74 attached to the back of annular pole piece 52 by means of a resilient surround 72 so that the diaphragm 34 is freely vibratable along the longitudinal axis. A cover housing 82 fits over the pole piece 52 so as to cover the diaphragm and extends over the pole piece's sides to its front surface. Mounted at the front of the pole piece 52 is a horn 80. The pole piece 52 has within it a bore through which sounds waves generated by the diaphragm at the bore's rear opening are transmitted to the horn. The pole piece bore's front opening is continuous with the throat of the horn and both are designated 66 in the figure. Within the bore of the pole piece 52 is phasing plug 30. FIG. 2 is a rear sectional view of the driver where the surround 72 has been partially cut away and the diaphragm 34 removed. As can be seen from FIGS. 1 and 2, coursing through the phasing plug 32 are annular air passages 60, 62, and 64 which are referred to herein at main air passages. Each of the main air passages 60, 62, and 64 serves as an acoustic pathway through the bore of the pole piece 52, as does a surrounding annular auxiliary air passage 70 to be described more fully below. As shown in FIG. 2, each of the air passages 60, 62, 64, and 70 are segmented rings being separated by longitudinal ribs 71 which connect concentric portions of the phasing plug 30 a well as connect the phasing plug 30 to the pole piece 52. The ribs 71 of air passage 70 do not extend completely to the rear face of the phasing plug so as to leave an annular recess 42 in which the voice coil is free to vibrate.

The diaphragm 34 is mounted adjacent the rear surface of the phasing plug 30 being separated by a thin space or compression region 32 in which the diaphragm is free to vibrate in a direction along the longitudinal axis. The diaphragm 34 is shown as having a central dome-shaped portion with the rear surface of phasing plug 30 being of corresponding sphericity. Attached to the diaphragm 34 around the circumference of its central dome-shaped portion, is a cylindrical voice coil 36 to which the signal voltage is applied. The coil 36 is wrapped perpendicular to the longitudinal axis usually around a longitudinally extending rim or form (not shown) of the diaphragm 34. In this embodiment, and in most compression drivers, the diaphragm 34 is mounted with its concave surface adjacent the phasing plug 30 in order for the mean path length through the annular air channels of the phasing plug from any point on the diaphragm to the throat 66 to be substantially uniform.

The voice coil 36 must be subjected to a static magnetic field in order to experience oscillation forces corresponding to the oscillatory signal current flowing through it. This is accomplished in all electrodynamic loudspeakers by disposing the voice coil within an air gap which is part of a magnetic circuit, the coil being free to vibrate with in the air gap. The magnetic circuit usually comprises a permanent magnet embedded within ferromagnetic material with the air gap being within the ferromagnetic material. The air gap, which will be referred to herein as the coil space, is made as short as possible in order to maximize the magnetic field intensity impinging on the coil for a given size magnet. For reasons of design simplicity and efficient use of material, it is desirable to place the magnetic circuit on the concave side of the diaphragm (i.e, the compression side) and construct the phasing plug and surrounding pole piece from ferromagnetic material. (Actually, only the outer portion of the phasing plug need be made of ferromagnetic material since no magnetic field lines which impinge on the voice coil pass through the inner portion.) This means that the voice coil and coil space must necessarily also be located on the concave side of the diaphragm. (It is possible, however, to design otherwise so that the voice coil is mounted on the convex side of the diaphragm. See, for example, U.S. Pat. No. 2,832,844, issued to Matsuoka. The present invention is not applicable to those designs where the phasing plug and voice coil are located on opposite sides of the diaphragm).

The embodiment in FIG. 1 thus shows the voice coil 36 being disposed within an annular coil space 42 in which it is free to vibrate in a direction along the longitudinal axis and cause corresponding vibration of diaphragm 34. An annular permanent magnet 14 is embedded within the outer concentric portion of the phasing plug 30 so as to produce a magnetic field having field lines such as that designated 46 in FIG. 1. In accordance with the present invention, the coil space 42 is continuous with annular auxiliary air passage 70 which serves as an acoustic pathway for soundwaves generated by the vibrating voice coil 36 (as well as vibrations of the surround 72 and outer edge of the diaphragm) to reach the throat 66. Without the auxiliary air passage, the sound energy generated by the voice coil 36, surround 72, and outer edge of the diaphragm, in addition to causing cavity resonance effects, would be wasted. Thus the present invention increases the efficiency of the loudspeaker, serves as a means for heat dissipation, and reduces parasitic resonances.

It should be noted, however, that the sound output from the vibrating voice coil 36 and surround 72 only adds to that from the vibrating dome of the diaphragm when the entire structure vibrates in phase in the diaphragm's fundamental mode. When the driving frequency (i.e., the frequency of the signal voltage) equals the second resonance frequency of the surround of the diaphragm, the dome and surround 72 vibrate in opposite phase causing their sound outputs to subtract from one another. Thus, only below the second resonance frequency does the auxiliary air passage 70 actually increase the efficiency of the loudspeaker. The reduction in cavity resonance effects is accomplished, however, at all driving frequencies.

Also in accordance with the present invention, the auxiliary air passage 70 may be designed so that its cross-sectional area increases in going from the coil space 42 to the throat 66. Adding an auxiliary air passage in the proximity of the magnet necessarily attenuates the magnetic field impinging on the voice coil because the air passage adds reluctance to the magnetic circuit. To minimize this added reluctance, the auxiliary air passage should take up no more volume than necessary. In order to compromise between this objective and providing an optimum path for soundwaves, the auxiliary air passage may be constructed so that its cross-sectional area is small in the proximity of the coil space and increases toward the throat 66. Additionally, the auxiliary air passage may be partially filled with ferromagnetic material so as to leave a plurality of narrow air passages (e.g., of the salt-shaker type) for transmitting sound from the coil space to the throat.

Figure 3:
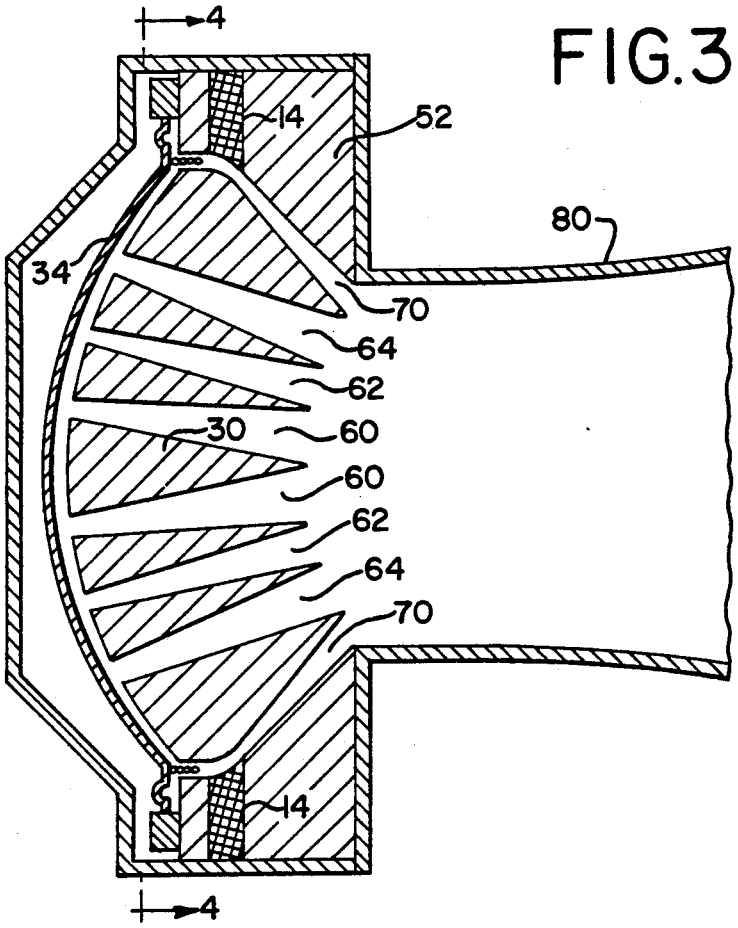
FIG. 3 is a sectional side view of an alternate embodiment of a compression driver in accordance with the present invention.
Figure 4:
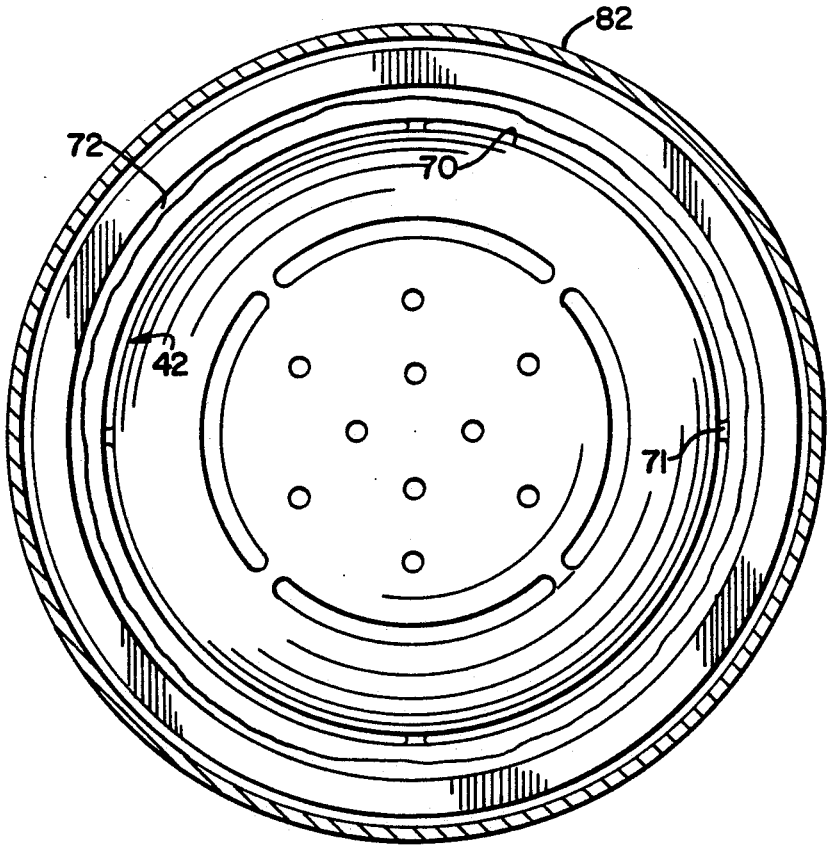
FIG. 4 is a cutaway rear view of a compression driver as shown in FIG. 1, taken along section lines 2—2 of FIG. 1, but with a combination of annular and salt-shaker type air passages in the phasing plug.
Figure 5:
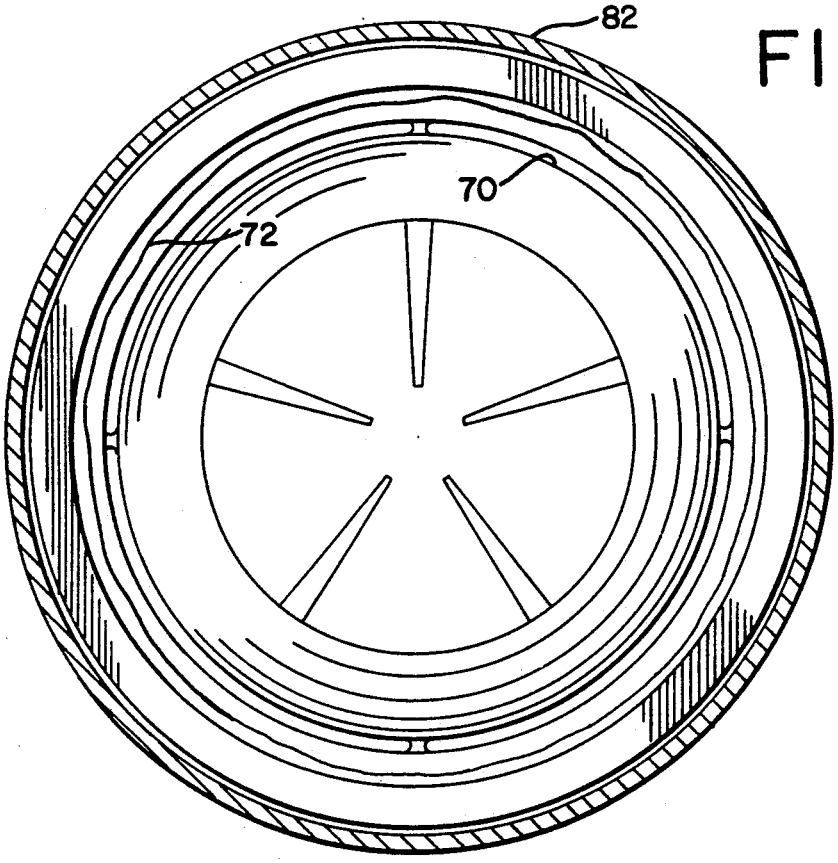
FIG. 5 is a cutaway rear view of a compression driver as shown in FIG. 1, taken along section lines 2—2 of FIG. 1, but with a radial slot type of phasing plug.

FIG. 3 shows another embodiment of the present invention in which the magnet 14 is located within the pole piece 52 instead of the phasing plug 30. The operation of this embodiment is exactly as described above with reference to the first embodiment. Also, the main air passages of the phasing plug 30 do not have to be annular but can be either of the salt-shaker or radial slot design as shown in the rear sectional views of FIGS. 4 and 5, respectively.

Figure 6:
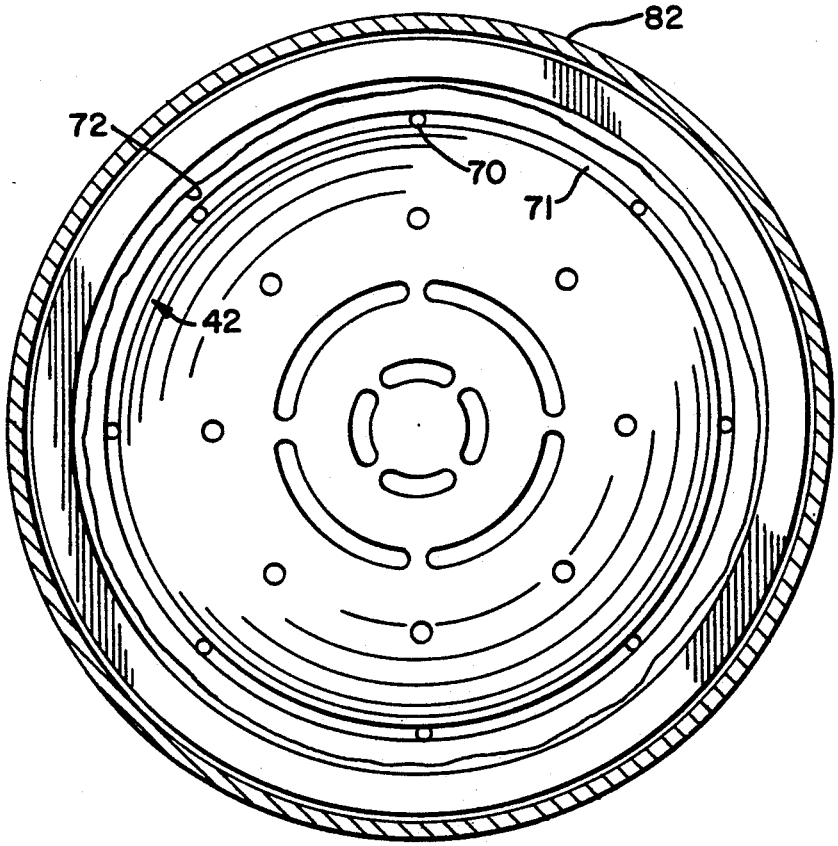
FIG. 6 is a cutaway rear view of a compression driver where the auxiliary air passage has been partially filled with ferromagnetic material so as to leave a plurality of salt-shaker type passages.

FIG. 6 shows a rear cutaway view of another embodiment of the present invention in which the auxiliary air passage 70 is partially filled with ferromagnetic material so as to reduce the reluctance added to the magnetic circuit. In this embodiment, the ribs 71 (made of ferromagnetic material) form a segmented annulus separated by round air passages 70 which are shown to be essentially of the salt-shaker type. The round air passages 70 extend all the way to the throat 66 and the ribs 71 may also so extend. As in the previous embodiments, however, the annular ribs 71 do not extend all the way to the rear of the phasing plug so as to leave an annular recess 42 (i.e., coil space) in which the coil is free to vibrate.

Although the invention has been described in conjunction with the foregoing specific embodiment, many alternatives, variations, and modifications will be apparent to those of ordinary skill in the art. Those alternatives, variations, and modifications are intended to fall within the scope of the following appended claims.

What is claimed is:

1. A compression driver, comprising: a pole along an axis piece having a bore therein with upstream and downstream ends, the downstream end of the bore being adapted for coupling to the throat of a horn;

a diaphragm mounted adjacent the upstream end of the bore so as to be vibratable and wherein vibration of the diaphragm produces sound waves directed through the bore toward its front end;

a cylindrical voice coil connected to the diaphragm and disposed within a coil space on the side of the diaphragm facing the pole piece so as to be vibratable within the coil space in a direction parallel to the axis of the pole piece bore;

means for generating a static magnetic field so that oscillatory current flowing through the voice coil causes vibratory motion of the voice coil and thereby vibration of the diaphragm;

a phasing plug disposed between the diaphragm and the upstream end of the bore and having one or more primary air passages for transmitting sound waves from the diaphragm to the downstream end of the bore; and, wherein an auxiliary air passage is provided for transmitting sound waves from the coil space to the front end of the bore.

2. The compression driver as set forth in claim 1 wherein the diaphragm is dome-shaped with its concave surface positioned adjacent a correspondingly shaped surface of the phasing plug in axial alignment with the bore, the diaphragm and phasing plug being separated by a space in which the diaphragm is free to vibrate.

3. The compression driver as set forth in claim 2 wherein the voice coil is mounted circumferentially around the diaphragm so as to extend into an annular coil space on the concave side of the diaphragm.

4. The compression driver as set forth in claim 3 wherein the auxiliary air passage is an annular slot from the coil space to the front end of the bore.

5. The compression driver as set forth in claim 4 wherein the cross-sectional area of the auxiliary air passage increases from the coil space to the front end of the bore as to minimize the added reluctance to the magnetic circuit which drives the voice coil.

6. The compression driver as set forth in claim 4 wherein the diaphragm is mounted by suspending it by means of a resilient surround connecting the circumference of the diaphragm to the rear of the pole piece.

7. The compression driver as set forth in claim 4 wherein the magnetic field generating means is an annular permanent magnet located within the phasing plug.

8. The compression driver as set forth in claim 4 wherein each primary air passage is an annular slot through the phasing plug which thereby provides an acoustic pathway from the diaphragm to the front end of the bore.

9. The compression driver as set forth in claim 4 wherein each primary air passage is a radial slot through the phasing plug which thereby provides an acoustic pathway from the diaphragm to the front end of the bore.

10. The compression driver as set forth in claim 4 wherein each primary air passage is a borehole extending through the phasing plug which thereby provides an acoustic pathway from the diaphragm to the front end of the bore.

11. The compression driver as set forth in claim 4 wherein the auxiliary air passage is divided into segments by longitudinal ribs which connect the pole piece and phasing plug.

12. The compression driver as set forth in claim 4 wherein the magnetic field generating means is an annular permanent magnet located in the pole piece.

13. The compression driver as set forth in claim 4 wherein the magnetic field generating means is an annular permanent magnet and further wherein the annular slot is thin in the proximity of the permanent magnet and increases in cross-sectional area going toward the front end of the pole piece bore.

14. The compression driver as set forth in claim 3 wherein the auxiliary air passage is a plurality of air passages continuous with the coil space and separated by ribs made of ferromagnetic material.

* * * * *